United States Patent [19]

Krauth

[11] Patent Number: 4,773,286

[45] Date of Patent: Sep. 27, 1988

[54] STRIKING TOOL, HEAD AND HANDLE AND METHODS OF MANUFACTURING THEM

[76] Inventor: Walter K. Krauth, 8705 N. Shore Dr., Jonesboro, Ga. 30236

[21] Appl. No.: 823,027

[22] Filed: Jan. 27, 1986

[51] Int. Cl.[4] ..... B25D 1/00

[52] U.S. Cl. ..... 81/20; 81/26; 30/308.1; 403/237

[58] Field of Search ..... 81/20, 26, 489, 177.85, 81/177.1, 22; 30/168, 340, 123, 308.1; 403/233, 234, 235, 236, 237

[56] References Cited

U.S. PATENT DOCUMENTS

| | | | |
|---|---|---|---|
| 316,528 | 4/1885 | Davis | 403/237 |
| 1,049,249 | 12/1912 | Martini | 403/237 |
| 1,336,185 | 4/1920 | Bantjes | 403/237 |
| 2,435,556 | 2/1948 | Curatole | 81/20 |
| 3,355,226 | 11/1967 | Portz | 306/32 |
| 3,770,033 | 11/1973 | Gavillet et al. | 145/61 |
| 4,023,606 | 5/1977 | Kneissl | 145/2 |
| 4,089,356 | 5/1978 | O'Connor | 145/29 |
| 4,334,563 | 6/1982 | Epel et al. | 145/2 |
| 4,558,726 | 12/1985 | Clay | 81/20 |

FOREIGN PATENT DOCUMENTS

| | | | |
|---|---|---|---|
| 749859 | 6/1956 | United Kingdom | 30/308.1 |

*Primary Examiner*—Frederick R. Schmidt
*Assistant Examiner*—Bradley I. Vaught
*Attorney, Agent, or Firm*—Kilpatrick & Cody

[57] ABSTRACT

Striking tools, heads and handles for such tools, and methods of manufacturing them. A tool head according to this invention employs a flange which extends from each side of the head between the forward and rear portions of the head. The portion of the head within the periphery of each flange is generally concave and narrows to form a web extending longitudinally in the striking direction to connect the forward and rear portions. The web may include at least one opening communicating between the two concave surfaces. The flanges increase the cross-sectional area and moment of inertia of the head relative to the striking direction and relative to the handle axis. The resulting head enjoys greater strength and resistance to translational forces, bending moments, deformation and potential failure. Portions of the handle extending through the opening in the head and thereby about portions of the head reduce the possibility that the head will leave the handle as the tool is being swung. A minimum of surfaces required to be machined reduces finishing labor and expense.

12 Claims, 2 Drawing Sheets

STRIKING TOOL, HEAD AND HANDLE AND METHODS OF MANUFACTURING THEM

This invention relates to striking tools, striking tool heads and handles and methods of manufacturing such tools, heads and handles.

BACKGROUND OF THE INVENTION

Striking tools such as hammers, axes, hatchets, picks, adzes and mattocks are subjected to tremendous forces and moments during use. The tools are swung at great speeds and their heads are brought to a halt in fractions of a second and in very short distances. As a result, great kinetic energy is rapidly absorbed by the head and handle and by the object being struck. This energy creates substantial forces on the head, handle and object, and, in particular, on the connection between the head and handle.

Such tools are also subjected to tremendous centripetal forces as their massive heads are rapidly swung by their handles. These forces tend to pull tool heads off of their handles while the tools are in motion.

Further, because the travel of such tool heads is in a generally circular path, they possess significant rotational kinetic energy which is rapidly dissipated upon impact. Such tools are thereby subjected to significant impact-related rotational forces, in addition to the translational forces mentioned above, which cause failure of the head and handle. Additional forces are created when such tools are used for prying, such as to remove nails or dislodge ore.

A typical method of fastening tool heads to handles is to insert a portion of a tool handle through a vertical opening in the head and secure it with a wedge. This technique has been used for many years for wooden handles and has been used in various forms with plastic or composite material handles. An example is disclosed in U.S. Pat. No. 3,770,033 to Gavillet et al. Such tool heads suffer because of reduced cross-sectional area in regions where the hole is located, however. This smaller cross-sectional area causes structural weakness in and potential failure of the tool head. The head of such a tool also may separate from the handle while the tool is being swung after prolonged use or abuse and repeated cycles of impact.

Efforts to overcome the possibility of heads separating from handles of such tools include configuring heads to have a forward striking portion connected to a rear mass or striking portion by a member having smaller cross-section perpendicular to the striking direction. A plastic handle for such a tool may be molded or wrapped around the narrow member during manufacture. While this configuration presents some advantages for attachment of the handle, such heads frequently fail, however, because of the inability of the connecting member with its reduced cross-section area and moment of inertia to absorb the tremendous forces and moments placed on it by the rear portion of the head which must be supported as the head is brought to an abrupt halt from its circular path of travel.

SUMMARY OF THE INVENTION

A tool head according to the present invention allows the handle to extend completely around portions of its structure, but the head also has flanges which extend from its sides. These flanges increase the head's cross-sectional area and moment of inertia and thus its resistance to translational and rotational forces, potential deformation and failure.

Portions of each side surface of such a head within the periphery of its corresponding flange are curved inwardly to form a generally dove-tail shaped hollowed out or concave surface. Each concave surface may communicate with its corresponding surface on the other side through an opening extending transversely through the head. Portions of the resulting head structure are generally T-shaped in cross-section normal to the striking direction causing the head to have an increased cross-sectional area and moment of inertia relative to that direction.

The head is generally I-shaped in cross-section in portions normal to the handle axis and thus also has additional cross-sectional area, moment of inertia and strength properties relative to that direction.

The curved surfaces within the flanges provide a large surface area for contact between the tool handle and the head to minimize the possibility of concentration of stresses emanating into the handle from portions of the head. The resulting head structure is also light in weight but strong and very firmly attached to the handle so that the potential for the head to separate from the handle or fail during use is minimized.

It is therefore an object of the present invention to provide a tool having a head with side flanges to increase the cross-sectional area and moment of inertia of portions of the head relative to the striking direction in order to resist translational forces and bending moments which are a potential cause of deformation and failure.

It is another object of the present invention to provide a tool head having portions with a T-shaped cross-section relative to the striking direction to increase the cross-sectional area and moment of inertia relative to that direction and thereby resist translational forces and bending moments which tend to cause deformation and failure.

It is an additional object of the present invention to provide a tool head having portions with an I-shaped cross-section relative to the handle axis to increase the area and moment of inertia relative to that axis and thereby resist translational forces and bending moments which tend to cause deformation and failure.

It is an additional object of the present invention to provide a striking tool head having a large surface area to contact the handle in order to increase the contact area between the head and the handle and to minimize concentration of stresses emanating into the handle from the head.

It is a further object of the present invention to provide a striking tool head having increased surface area normal to the striking direction to minimize concentration of impact forces between the head and the handle in the striking direction.

It is a further object of the present invention to provide a striking tool head having a generally curved surface area between the head and the handle to minimize concentration of stresses emanating into the handle from the head and to distribute loads placed on the handle by the head during use.

It is a further object of the present invention to provide a striking tool head having at least one opening extending transverse to the striking direction and the handle axis in order to increase the surface area of contact between the head and the handle and to allow portions of the handle to extend around portions of the head and thereby reduce the potential of the head to separate from the handle during use.

It is a further object of the present invention to provide a striking tool head having a dove-tailed portion for receiving the tool handle in order to reduce the likelihood that the head will leave the handle as the tool is swung.

It is a further object of the present invention to provide a stiking tool that requires a minimum of finishing during manufacturing.

Other objects, features and advantages of the present invention will become apparent with reference to the remainder of the specification and drawings of this document.

DETAILED DESCRIPTION OF THE DRAWINGS

Figure 1:
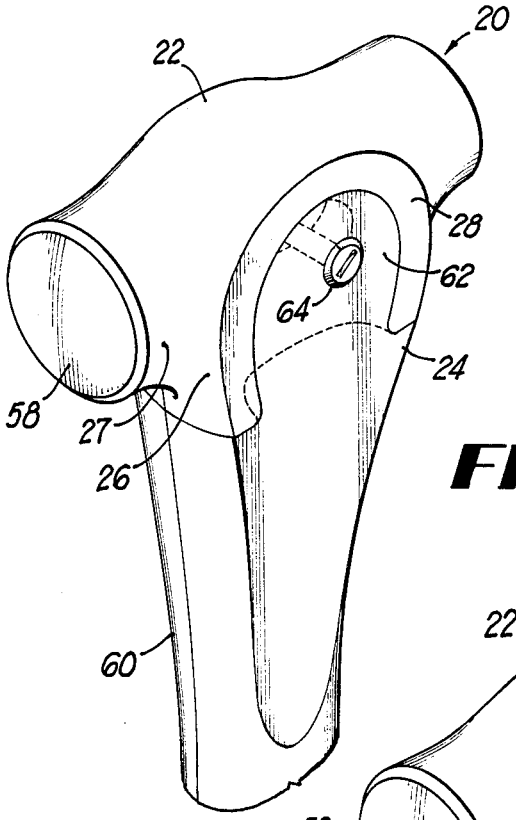
FIG. 1 is a perspective view of one embodiment of a striking tool according to the present invention.

FIG. 1 generally illustrates in perspective a first embodiment of a striking tool 20 of the present invention. Head 22 receives and is connected to handle 24. Flange 26 extends from side 27 of tool head 22 and terminates in flange face 2S. Head 22 is typically formed of hardened steel, but may be formed of other appropriate material having requisite cost, strength, weight and other properties.

Figure 2:
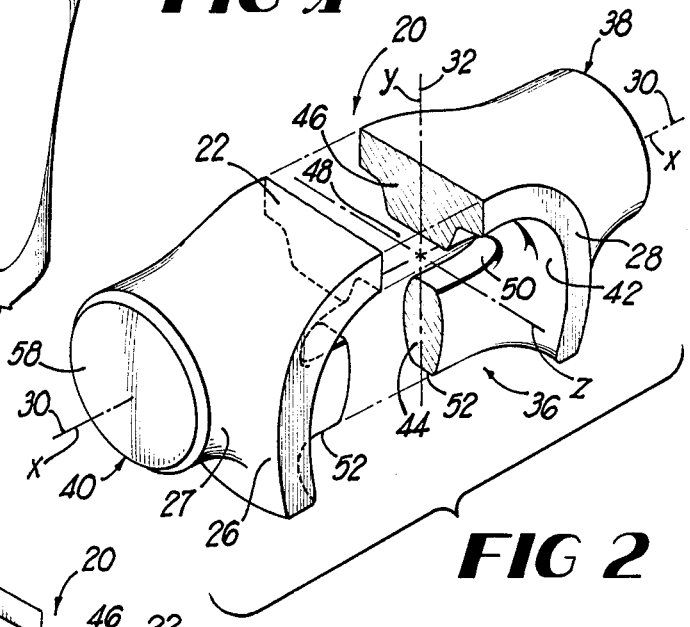
FIG. 2 is a partially exploded perspective view of the embodiment shown in FIG. 1.

FIG. 2 illustrates in partially exploded perspective view the head 22 of FIG. 1 imposed upon a three-dimensional cartesian frame of reference. Striking direction 30 corresponds generally to the x-axis of the system while handle axis 32 corresponds generally to the y-axis of the reference frame. The sides 27 of head 22 are located generally on the surfaces of head 22 in the positive and negative z-axis direction. For purposes of reference herein, top portions 34 of head 22 correspond generally to the positive y direction while bottom portions 36 correspond generally to the negative y direction. Forward portions 38 of head 22 correspond generally to the positive x direction while rear portions 40 correspond to the negative x direction.

FIG. 2 illustrates more clearly portions of head 22 shown covered by handle 24 in FIG. 1. Flange 26 of the embodiment of FIG. 2 forms a horseshoe-shaped structure extending from side 27 of head 22. A concave surface 42 extends in a curved fashion within the periphery of flange 26 to meet flange 26 at the outer periphery of surface 42 to form a bowl-like structure within flange face 28 on side 27 of head 22.

The portion of head 22 located between concave surfaces 42 forms a web 44 which connects forward portion 38 to rear portion 40 of head 22. Web 44 together with portions of flange 26 form a generally T-shaped cross-section 46 relative to the striking direction 30 at the top of the horseshoe. The upper portions of this cross-sectional area which extend in a positive and negative z direction from the center of head 22 greatly increase the moment of inertia of head 42 about the handle axis. This increased moment of inertia greatly increases head 22's strength properties and resistance to forces and bending moments. This feature is particularly important when head 22 strikes an object at an angle or in other than the striking direction 30 thus requiring web 44 and flange 26 to support rear portion 40 as it is brought to a rapid halt and therefore to absorb tremendous forces and moments transmitted by the rapidly dissipating translational and rotational kinetic energy of rear portion 40.

Opening 4S connecting concave surfaces 42 allows handle 24 to "wrap around" portions of head 22 and thereby decrease the possibility that head 22 will separate from handle 24 as tool 20 is being swung. Opening 48 creates a transition surface 50 which in the illustrated embodiment continuously and curvedly connects the two concave surfaces 42. Additionally, bottom transition surface 52 located on bottom portions of web 44 continuously and curvedly connects concave surfaces 42 in the embodiment shown in FIG.2.

Reference to FIG. 2 readily illustrates the sizeable surface area of contact between head 22 and handle 24 provided by concave surfaces 42, opening or inner transition surface 50 and bottom transition surface 52. An additional advantage of this structure is that it provides additional contact surface between head 22 and handle 24 in a direction perpendicular to striking direction 30 to distribute loads placed on handle 24 by head 22 over a large contact area. The structure thereby minimizes the concentration of stresses emanating into handle 24 from points on head 22.

The structure provided by concave surfaces 42 and flanges 26 as shown in FIG. 2 also allows handle 24 to dovetail into head 22 in the y direction. This structure provides a choking effect on upper portions of handle 24 by flanges 26 to counteract centripetal forces on head 22 as tool 20 is being swung and thus reduces the possibility that head 22 will leave handle 24 while tool 20 is in motion.

Figure 3:
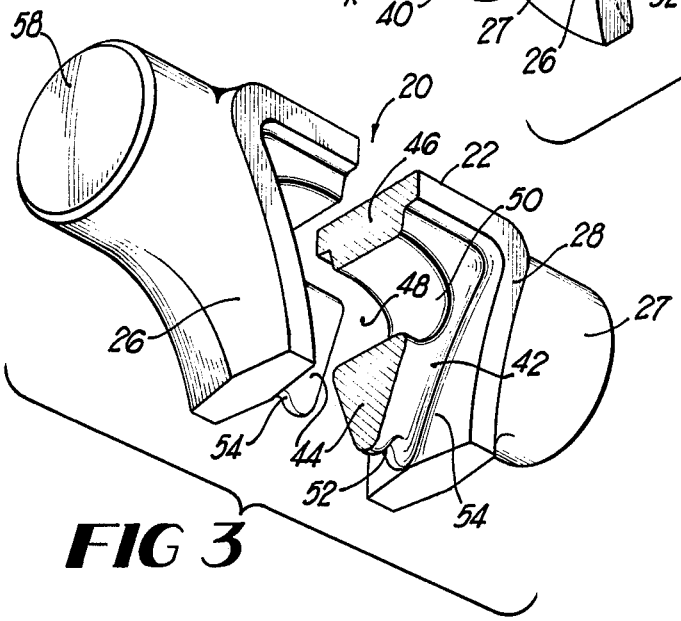
FIG. 3 is a side perspective view of a second embodiment of a striking tool according to the present invention.

FIG. 3 illustrates a generally side perspective view of a second embodiment of a heavier striking tool 20 according to the present invention. In this embodiment, flanges 26 more abruptly meet web 44 to form corners 54. Opening 48 is larger to increase resistance of head 22 to separate from handle 24 during use. Additional variations shown in FIG. 3 include addition of indentations 54 to bottom transition surface 52 to increase the gripping relationship between head 22 and handle 24. Other adaptations to flanges 26, concave surfaces 42, opening or openings 48 and transition surface 52 are also possible, including squaring those structures with respect to one another, making them different shapes or adding serrations or other friction increasing means to them. These adaptations may of course be added as well to the other embodiments of the invention as described and illustrated herein.

Figure 5:
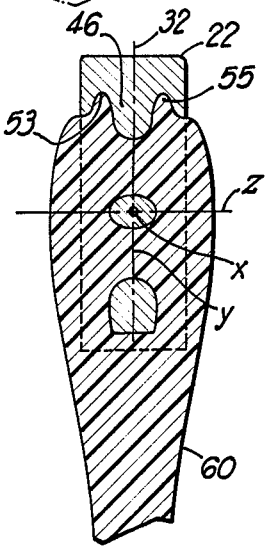
FIG. 5 is a front cross-sectional view of the striking tool of FIG. 4 taken along line 5—5 of FIG. 4.

The head 22 of FIG. 3 illustrates an additional feature of the present invention which allows handle 24 to grip head 22 securely. Pockets 53 may be located in the upper portion of concave surfaces 42 to receive corresponding lips 55 of handle 24. Such lips are shown in FIG. 5. This feature decreases the possibility that portions of handle 24 will separate in the positive and negative z direction from head 22. These pockets 53 additionally allow head 22 to be configured without openings 48. In this embodiment, the dove-tail structure provided by flanges 26 secures handle 24 in place parallel to the handle 24 longitudinal axis or in a positive and negative y direction, while pockets 53 secure lips 55 in place in the positive and negative z directions or transverse to the handle axis and thereby prevent handle 24 from escaping the voids created by concave surfaces 42.

Figure 4:
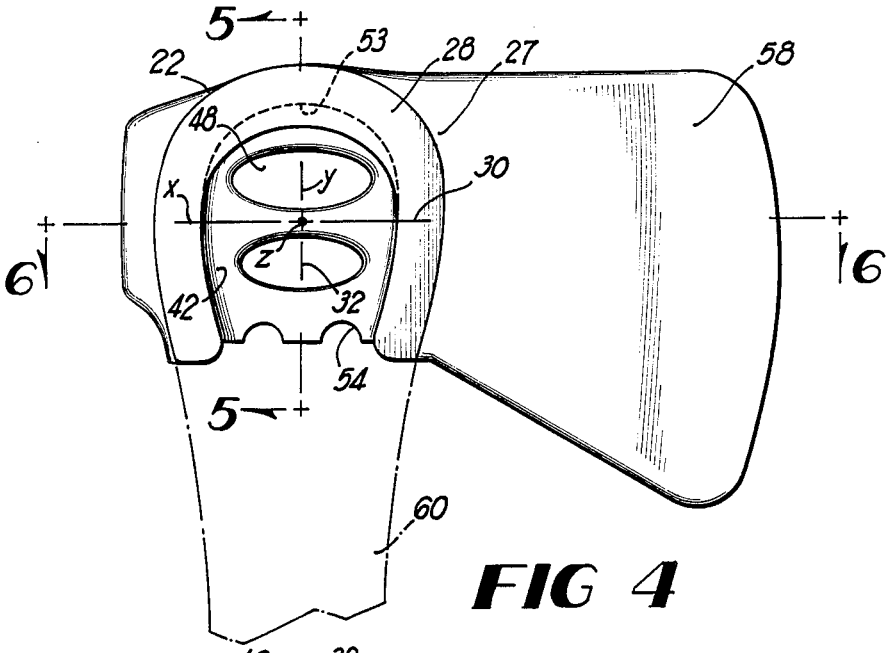
FIG. 4 is a side elevational view of a third embodiment of a striking tool according to the present invention.

FIG. 4 illustrates such variations on an ax head 22. Head 22 of the ax of FIG. 4 has two openings 48 and two indentations 54 in bottom transition surface 52. Flanges 2S are rounded in the bottom portions 36 of head 22 to meet the bottom surfaces of head 22 in a continuous and curved fashion in order to reduce point stresses on handle 24 which would otherwise be caused by squared edges of head 22. FIG. 5 shows generally the T-shaped cross-section 48 of portions of head 22, the beneficial properties of which cross-section have been described above.

Figure 6:
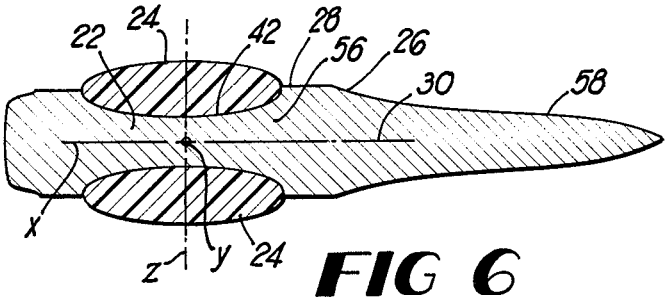
FIG. 6 is a bottom cross-sectional view of the striking tool of FIG. 4 taken along line 6—6 of FIG. 4.

FIG. 6 illustrates a bottom cross-sectional view of the head 22 of FIG. 4. The generally I-shaped cross-section of head 22 in the direction of handle axis 32 caused by flanges 26 and concave surfaces 42 greatly increases the moment of inertia and cross-sectional area of head 22 about striking direction 30, with concomitant strength and resistance to deformation as described above accruing from T-shaped cross-section 46.

Head 22 may be manufactured by drop forging, casting or other appropriate conventional methods. Conveniently, flange faces 28 and striking surfaces may be easily and conveniently machined with a minimum of labor. Flange faces 2B may for instance be machined in a single operation by placing head 22 between grinding elements and machining faces 28 at the same time. If head 22 is a double ended hammer head, striking faces 58 may be similarly machined at the same time.

Handle 24 may be fitted to head 22 according to various methods. In a first method, head 22 may be placed in a mold having mold surfaces conforming to the desired shape of handle 24. Other mold surfaces may conveniently form sealing contact with flange faces 28 in order to establish a mold cavity defined by the handle contacting surfaces of head 22 and the handle-forming mold surfaces. Suitable material including, for instance, fiberglass reinforced plastics, other composites or a wide variety of conventional polymeric material may be introduced into the mold to surround concave surfaces 42, opening transition surfaces 50, bottom transition surface 52 and portions of flange faces 28 to fasten handle 24 to head 22 securely, as will be readily recognized by one skilled in the art. Particularly desirable handle materials are nylon composites.

Handle 24 may also be formed in a separate operation. The shank portion 60 of handle 24 extends longitudinally to form two tines 62 whose side surfaces are generally contiguous with the side surfaces of shank 60. The inner surfaces of tines 62 conform to the concave surface 42, inner transition surfaces 50 and bottom transition surface 52 of head 22. The portions which would otherwise fill opening 48 may simply be convex surfaces on the interior side of tines 62, however. Handle 24 may then be snapped or biased into place against head 22 by temporarily spreading the tines 62 to secure head 22 to handle 24 in a gripping relationship. Head 22 and handle 24 are then preferably fastened together with a fastener 64 which prevents tines 62 from spreading apart during use of the tool. Fastener 64 may be a bolt as shown in FIG. 1, or it may be a rivet or other appropriate similar fastening means. Alternatively, tines 62 may be bonded together through opening or openings 42 with a suitable adhesive.

This disclosure is intended for purposes of illustration and explanation. Striking tools, heads and handles may be modified and adapted without departing from the invention or its scope or spirit.

I claim:

1. A striking tool, comprising:

I. a tool head, comprising:

(a) at least one striking surface; and (b) at least one surface for connection to a handle, comprising:

(i) two concave surfaces, each located on a side of the head and each of whose peripheral edges defines a flange;

(ii) a bottom curved transition surface connecting portions of the concave surfaces and located toward the bottom of the head; and (iii) at least one opening which forms an inner curved transition surface connecting the two concave surfaces; and II. a handle formed of a moldable material and molded to the tool head to contact the two concave surfaces, portions of the flanges, the bottom transition surface and portions of the inner transition surface.

2. A striking tool according to claim 1 in which the handle is of nylon.

3. A striking tool, comprising:

I. a tool head, comprising:

(a) at least one striking surface;

(b) two flanges, each extending from a side of the head;

(c) a web having two curved connection surfaces, the peripheral portion of each of which connection surface abuts one of the flanges; and (d) at least one opening in the web which forms an inner curved transition surface connecting the two connection surfaces; and II. a handle formed of a moldable material and molded to the tool head to contact the web and portions of the flanges.

4. A method of making a striking tool, comprising:

(a) providing a tool head comprising;

(a) at least one striking surface; and (b) at least one surface for connection to a handle, comprising:

(i) two concave surfaces, each located on a side of the head and each of whose periphreal edges defines a flange;

(ii) a bottom curved transition surface connecting portions of the concave surfaces and located toward the bottom of the head; and (iii) at least one opening which forms an inner curved transition surface connecting the two concave surfaces; and a handle formed of a moldable material and molded to the tool head to contact the two concave surfaces, portions of the flanges, the bottom transition surface and portions of the inner transistion surface;

5. A method of making a striking tool, comprising:

(a) providing a tool head comprising;

(a) at least one striking surface; and (b) at least one surface for connection to a handle, comprising:

(i) two concave surfaces, each located on a side of the head and each of whose peripheral edges defines a flange;

(ii) a bottom curved transition surface connecting portions of the concave surfaces and located toward the bottom of the head; and (iii) at least one opening which forms an inner curved transition surface connecting the two concave surfaces; and a handle formed of a moldable material and molded to the pool head to contact the two concave surfaces, portions of the flanges, the bottom transition surface and portions of the inner transistion surface;

6. A striking tool, comprising:

I. a tool head, comprising:

(a) at least one striking surface; and (b) at least one surface for connection to a handle, comprising:

(i) two concave surfaces, each located on a side of the head and each of whose peripheral edges defines a flange;

(ii) a bottom curved transition surface connecting portions of the concave surfaces and located toward the bottom of the head; and (iii) at least one opening which forms an inner curved transition surface connecting the two concave surfaces; and II. a handle formed of an moldable material and attached to the tool head to contact the two concave surfaces, portions of the flanges, the bottom transition surface and portions of the inner transition surface; and III. a fastener extending from one handle side to the other and passing through the opening to fasten the handle to the head.

7. A striking tool according to claim 6 in which the handle is of nylon.

8. A striking tool according to claim 6 in which the fastener comprises a nut and bolt.

9. A striking tool, comprising:

I. a tool head, comprising:

(a) at least one striking surface;

(b) two flanges, each extending from a side of the head;

(c) a web having two curved connection surfaces, the peripheral portion of each of which connection surface abuts one of the flanges; and (d) at least one opening in the web which forms an inner curved transition surface connecting the two connection surfaces;

II. a handle formed of a moldable material and attached to the tool head to contact the web and portions of the flanges; and III. a fastener extendig from one handle side to the other and passing through the opening to fasten the handle to the head.

10. A striking tool according to claim 9 in which the handle is of nylon.

11. A striking tool according to claim 9 in which the fastener comprises a nut and bolt.

12. A striking tool according to claim 3 in which the handle is of nylon.

* * * * *